United States Patent [19]

Efferding

[11] Patent Number: 4,983,352

[45] Date of Patent: Jan. 8, 1991

[54] CLOSURE SYSTEM FOR A SPENT FUEL STORAGE CASK

[75] Inventor: Larry E. Efferding, Pensacola, Fla.

[73] Assignee: Westinghouse Electric Corp., Pittsburgh, Pa.

[21] Appl. No.: 442,434

[22] Filed: Nov. 24, 1989

Related U.S. Application Data

[63] Continuation of Ser. No. 670,727, Nov. 13, 1984, abandoned.

[51] Int. Cl.[5] ..... G21C 17/00

[52] U.S. Cl. ..... 376/272; 376/250; 73/49.3

[58] Field of Search ..... 376/272, 250, 203, 205, 376/206, 204, 251; 250/506.1, 507.1; 73/49.1, 49.3

[56] References Cited

U.S. PATENT DOCUMENTS

| | | | |
|---|---|---|---|
| 3,393,552 | 7/1968 | Burgess | 73/49.3 |
| 3,982,134 | 9/1976 | Housholder et al. | 250/506.1 |
| 4,078,968 | 3/1978 | Golden et al. | 376/205 |
| 4,197,467 | 4/1980 | Williams | 250/506.1 |
| 4,274,007 | 6/1981 | Baatz et al. | 376/272 |
| 4,278,892 | 4/1981 | Baatz et al. | 376/272 |
| 4,356,144 | 10/1982 | Cheung et al. | 376/205 |
| 4,419,883 | 12/1983 | Gelston, II | 73/49.3 |
| 4,445,042 | 7/1984 | Baatz et al. | 376/272 |
| 4,447,733 | 5/1984 | Baatz et al. | 250/506.1 |
| 4,456,827 | 6/1984 | Botzem et al. | 376/272 |
| 4,495,139 | 1/1985 | Janberg et al. | 250/506.1 |
| 4,528,454 | 7/1985 | Baatz et al. | 250/506.1 |
| 4,636,645 | 1/1987 | Kessinger | 376/272 |

FOREIGN PATENT DOCUMENTS

| | | | |
|---|---|---|---|
| 031048A1 | 7/1981 | European Pat. Off. . | |
| 0049438 | 4/1982 | European Pat. Off. | 376/272 |
| 049439A1 | 4/1982 | European Pat. Off. . | |
| 3010518 | 10/1981 | Fed. Rep. of Germany | 376/272 |
| 3025795 | 1/1982 | Fed. Rep. of Germany | 376/272 |
| 1521773 | 8/1978 | United Kingdom . | |
| 2010164B | 6/1979 | United Kingdom . | |
| 2042403B | 12/1982 | United Kingdom . | |

OTHER PUBLICATIONS

Horst Keese, "The TN 1300 Shipping/Storage Cask System for Spent Fuel," *Nuclear Europe*, 2/1983, pp. 17–18.

*Primary Examiner*—Daniel D. Wasil
*Attorney, Agent, or Firm*—D. C. Abeles

[57] ABSTRACT

A closure system of a spent fuel storage cask includes a lid assembly having a shield lid which is installed under water and which cooperates in the drainage of water from the cask. A primary cover having a spring energized metalic C-ring captured therein to provide a primary gas seal is then installed over the shield lid. Closable gas passages extending through the primary cover permit the primary gas seal to be tested by injecting pressurized gas on one side of the primary gas seal and testing for leakage on the other. A seal cover is installed over the primary cover and welded at its periphery to provide the secondary gas seal. The seal cover has a closable gas passage which allows pressurized gas to be injected between the primary cover and the sealed cover so that leaks at the secondary gas seal can be detected. The closure system may also include a gas pressure monitoring system which communicates with the interior of the cask and which can be recalibrated during long-term storage of spent fuel.

21 Claims, 6 Drawing Sheets

FIG. 3.
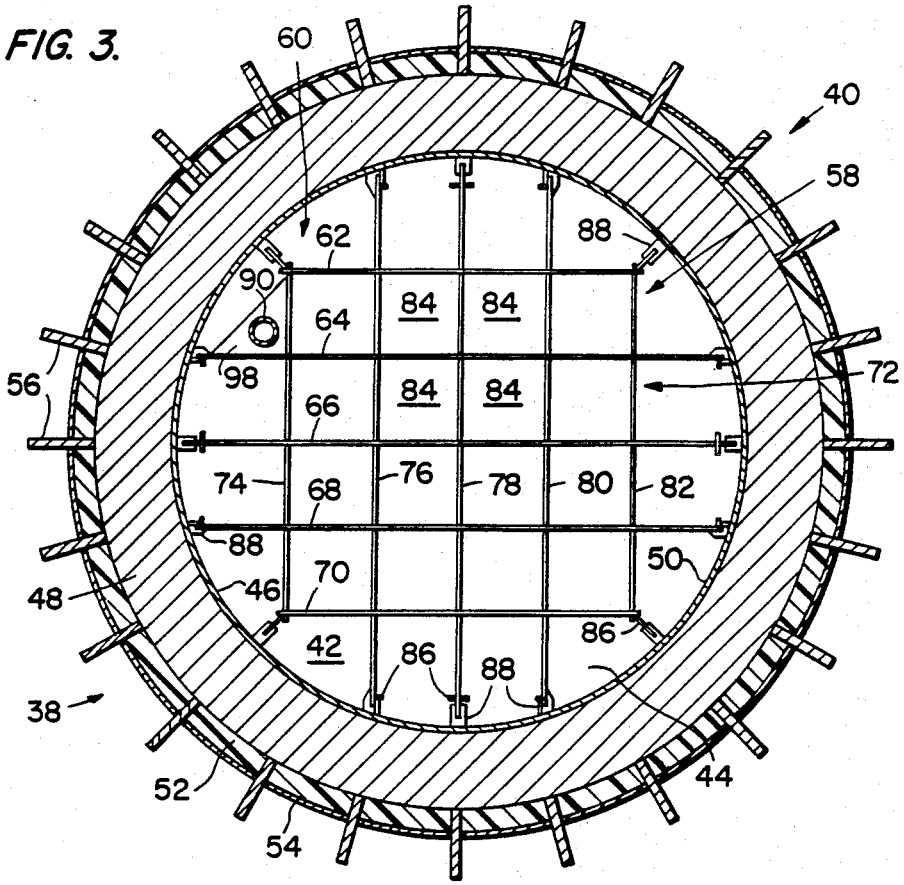
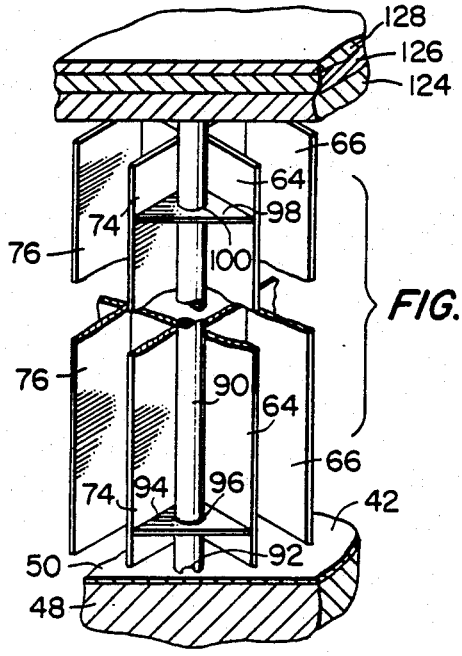
FIG. 4.

CLOSURE SYSTEM FOR A SPENT FUEL STORAGE CASK

This application is a continuation of application Ser. No. 06.670,727, filed Nov. 13, 1984, now abandoned.

CROSS-REFERENCE TO RELATED APPLICATION

The subject matter of the present application is related to the subject matter of a patent by David A. Daugherty et al entitled "Spent Fuel Storage Cask Having Continous Grid Basket Assembly," which has been assigned Pat. No. 4,781,883 and which is owned by the assignee of the present application.

BACKGROUND OF THE INVENTION

The present invention is related to the long-term storage of spent fuel that has been removed from a nuclear reactor, and more particularly, to a spent fuel storage cask having a highly reliable closure system which can be tested for leaks as the cask is being sealed and thereafter, during long-term storage of the spent fuel.

FIG. 1 illustrates a typical fuel assembly 20 for supplying nuclear fuel to a reactor. Assembly 20 includes a bottom nozzle 22 and a top nozzle 24, between which are disposed elongated fuel rods 26. Each fuel rod 26 includes a cylindrical housing made of zirconium alloy such as commercially available "zircalloy-4", and is filled with pellets of fissionable fuel enriched with U-235. Within the assembly of fuel rods 26, tubular guides (not shown) are disposed between nozzles 22 and 24 to accommodate movably mounted control rods (not illustrated) and measuring instruments (not illustrated). The ends of these tubular guides are attached to nozzles 22 and 24 to form a skeletal support for fuel rods 26, which are not permanently attached to nozzles 22 and 24. Grid members 28 have apertures through which fuel rods 26 and the tubular guides extend to bundle these elements together. Commercially available fuel assemblies include between 179 and 264 fuel rods, depending upon the particular design. A typical fuel assembly is about 4.1 meters long, about 19.7 cm wide, and has a mass of about 585 kg.

After a service life of about 3 years in a pressurized water reactor, the U-235 enrichment of a fuel assembly 20 is depleted. Furthermore, a variety of fission products, having various half-lives, are present in rods 26. These fission products generate intense radioactivity and heat when assemblies 20 are removed from the reactor, and accordingly the assemblies 20 are moved to a pool containing boron salts dissolved in water (hereinafter "borated water") for short-term storage. Such a pool is designated by reference number 30 in FIG. 2.

Pool 30 is typically 12.2 meters deep. A number of spent fuel racks 32 positioned at the bottom of pool 30 are provided with storage slots 34 to vertically accommodate fuel assemblies 20. A cask pad 36 is located at the bottom of pool 30.

During the period when fuel assemblies 20 are stored in pool 30, the composition of the spent fuel in rods 26 changes. Isotopes with short half-lives decay, and consequently the proportion of fission products having relatively long half-lives increases. Accordingly, the level of radioactivity and heat generated by a fuel assembly 20 decreases relatively rapidly for a period and eventually reaches a state wherein the heat and radioactivity decrease very slowly. Even at this reduced level, however, rods 26 must be reliably isolated from the environment for the indefinite future.

Dry storage casks provide one form of long-term storage for the spent fuel. After the heat generated by each fuel assembly 20 falls to a predetermined amount—such as 0.5 to 1.0 kilowatt per assembly, after perhaps 10 years of storage in pool 30—an opened cask is lowered to pad 36. By remote control the spent fuel is transferred to the cask, which is then sealed and drained of borated water. The cask can then be removed from pool 30 and transported to an above-ground storage area for long-term storage.

The requirements which must be imposed on such a cask are rather severe. The cast must be immune from chemical attack during long-term storage. Furthermore, it must be sufficiently rugged mechanically to avoid even tiny ruptures or fractures during long-term storage and during transportation, when the cask might be subjected to rough treatment or accidents such as drops. Moreover, the cast must be able to transmit heat generated by the spent fuel to the environment while nevertheless shielding the environment from radiation generated by the spent fuel. The temperature of the rods 26 must be kept below a maximum temperature, such as 375° C., to prevent deterioration of the zirconium alloy housing. Provisions must also be made to ensure that a chain reaction cannot be sustained within the cask; that is, that the effective criticality factor $K_{eff}$ remains less than one so that a self-sustaining reaction does not occur. These requirements impose stringent demands upon the cask, which must fulfill its storage function in an utterly reliable manner.

The aforesaid related application is directed to a spent fuel storage cask for long-term storage of spent nuclear fuel following short-term storage in a pool of water. The cask includes a grid basket assembly, resembling a matrix of elongated pigeonholes, for accommodating cells which in turn accommodate spent fuel assemblies. The grid basket assembly is formed by metal plates which transmit heat to channel sections affixed to the interior walls of the cask. The edges of the plates movably fit into the channel sections in order to permit radial movement of the grid basket assembly with respect to the walls of the cask as temperature changes. During storage the cask may be flooded with helium, which readily transmits heat through narrow gaps between the edges of the plates and the walls of the channel sections. The cask, which may have a mass of over a hundred thousand kilograms when loaded with spent fuel, is typically about 4.8 meters high and about 2.5 meters in diameter, excluding cooling fins. The closure system of the present invention is particularly adapted for use in such a cask.

SUMMARY OF THE INVENTION

A primary object of the present invention is to provide a cask having a closure system which seals spent fuel within the cask with a high degree of reliability and which permits testing of the seal fqr gas leaks as the cask is being closed and thereafter.

Another object of the invention is to provide a cask having a closure system which includes a lid assembly that cooperates with a cask base element, the cask base element having a stepped mouth region which is sealed in successive steps by different cover elements that are part of the cask lid assembly.

Another object of the present invention is to provide a cask having a closure system which includes a cask lid assembly having closure elements that facilitate drainage of borated water from the cask when spent fuel is being loaded therein, that provide a primary gas seal and permit testing thereof as the lid assembly is being installed, and that provide a secondary gas seal and permit testing thereof when the lid assembly is being installed and thereafter.

Another object of the present invention is to provide a cask having a closure system which includes a lid assembly having a closure element that supports a spring energized metal C-ring which provides a primary gas seal, the closure element having conduits communicating inside the primarily sealed region and outside the primarily sealed region in order to permit testing of the primary gas seal.

Another object of the present invention is to provide a cask having a closure system wherein a pressure sensor is mounted within the cask base element and communicates with the interior of the cask so that the gas pressure therein can be monitored, with provisions also being made for calibrating the pressure sensor during storage of spent fuel.

These and other objects are attained by providing a cask which includes a base element and a lid assembly having a primary cover which cooperates with the mouth region of the base element. The primary cover includes an annular recess into which a spring energized metal C-ring is installed to provide a primary gas seal between the primary cover and the mouth region of the base element. The primary cover includes a first closable gas passage terminating on one side of the C-ring and a second closable gas passage terminating on the other side, so that gas can be injected into the first passage in order to detect whether leakage appears at the second passage. Preferably the second passage opens between the C-ring and an elastomer O-ring provided in the primary cover in order to provide an isolated region of relatively small volume with which the second gas passage communicates.

According to one aspect of the invention, the mouth region of a cask having water and spent fuel therein is first sealed with a shield lid which is able to withstand mechanical impacts imparted by accidents such as drops. The shield lid preferably includes an elasto-mer O-ring which cooperates with the mouth region of the cask base element, a closable channel for accommodating a standpipe, and a closable gas passage for injecting gas into the cask while water is removed through a hose temporarily installed in the standpipe. After removal of the water, the primary cover is installed, and thereafter a seal cover is welded into place, the weld providing the secondary gas seal. The seal cover includes a closable gas passage in order to provide a redundancy check of gas leakage past the primary seal as the cover is installed and in order to permit testing of leakage during long-term storage.

In accordance with another aspect of the invention a gas pressure sensor assembly communicating with the interior of the cask is installed in a cavity in the cask base element in order to provide an alarm signal if the pressure within the cask reaches a predetermined level. Such an alarm signal may indicate either an anomalous situation requiring immediate attention or it may be benign, simply indicating that the calibration of the transducer has drifted. A closable gas passage to the cavity is provided in the cask base element in order to permit injection of gas for recalibrating the transducer if an alarm signal is emitted.

BRIEF DESCRIPTION OF THE DRAWINGS

FIG. 3 is a sectional view illustrating the base element of a storage cask, and a grid basket assembly within the base element for providing a matrix of storage slots for accommodating spent fuel assemblies, for transmitting heat generated by the spent assemblies to the cask wall, and for supporting a standpipe used during drainage of the cask;

FIG. 4 is a perspective view of the standpipe illustrated in FIG. 3, and shows the mounting of the standpipe to the grid basket assembly;

DESCRIPTION OF THE PREFERRED EMBODIMENTS

Figure 2:
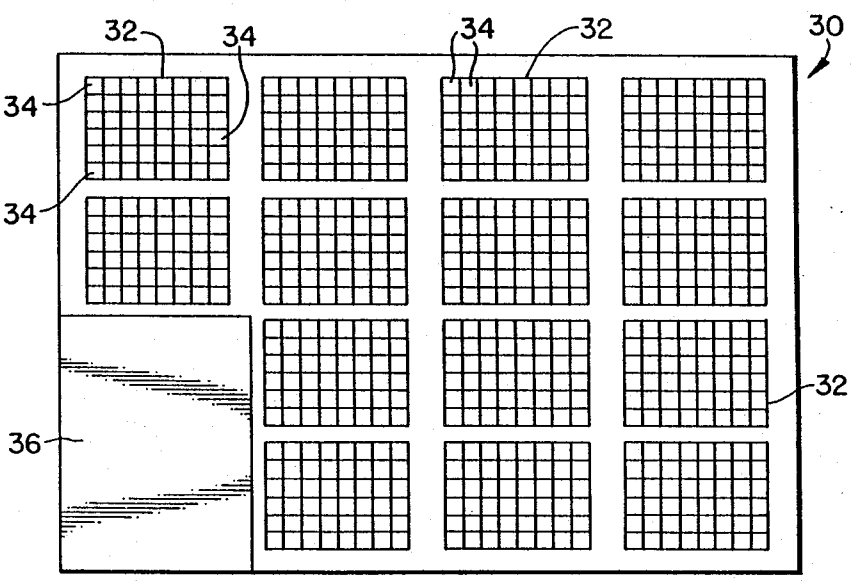
FIG. 2. (PRIOR ART)
FIG. 2 is a top plan view of a pool for short-term storage of spent fuel assemblies.
Figure 1:
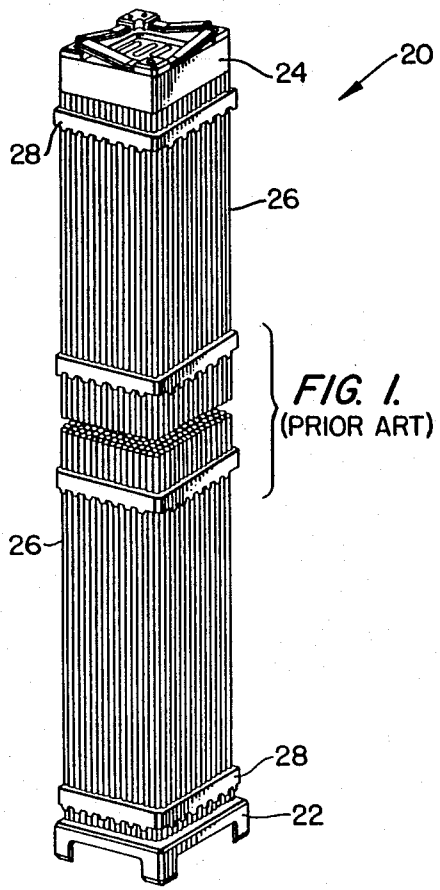
FIG. 1. (PRIOR ART)
FIG. 1 is a perspective view of a typical fuel assembly.

Before proceeding with a description of the closure system of the present invention, it would be useful to briefly summarize major features of the cask disclosed in the aforesaid related application. With reference to FIG. 3, cask base element 38 of cask 40 has a floor 42 and a hollow interior 44 provided by cylindrical wall 46. Base element 38 includes a carbon steel portion 48 which is approximately 25 cm thick and which serves to protect the environment from gamma rays. A stainless steel cladding layer 50 covering floor 42 and wall 46 is applied to portion 48, for example, by placing portion 48 on a turntable and rotating it while welding a continuous spiral path around the interior using stainless steel welding rods, so that a stainless steel surface covers the interior 44 of portion 48 entirely in order to protect it from chemical attack. Base element 38 is surrounded by a layer about 7.0 cm thick of neutron absorbing material 52, which may be resin. A suitable resin for use as material 52 is commercially available from Bisco Products, Inc., 1420 Renaissance Drive, Park Ridge, Ill. 60068, under Stock No. NS-3. Surrounding material 52 is an outer layer 54 of stainless steel to protect cask 40 from the environment. Cask 40 also includes cooling fins 56 of carbon steel, preferably treated to protect the carbon steel from chemical attack by the environment. Fins 56 are welded to portion 48 and extend through material 52 and layer 54. Although not illustrated it is advantageous to affix a pair of trunnions at the top and bottom of base element 38 in order to facilitate handling.

With continuing reference to FIG. 3, grid basket assembly 58 includes a first set 60 of major plate 62, 64, 66, 68, and 70, and a second set 72 of major plates 74, 76, 78, 80, and 82. These plates may be fabricated of aluminum sheets approximately 3.7 meters high and 2.0 cm thick. During fabrication the metal plates of first set 60 are provided with upwardly oriented elongated slots (not illustrated) which extend from the bottom to the middle of the plates and which are positioned about 26.3 cm apart. The plates of second set 72 are provided with corresponding elongated slots (not illustrated) which extend from the top of the plates to the middle thereof and which are also positioned about 26.3 cm apart. The plates of first set 60 and second set 72 are then assembled by inserting the slots into each other (in much the same manner that combs can be meshed by orienting their teeth toward each other and then bringing the combs together) and then welding the resulting intersections using full length fillet welds. It will be apparent such a construction provides a matrix of elongated storage slots 84 which are positioned about 26.3 cm apart, center-to-center, and which have axes extending substantially perpendicular to floor 42. Grid basket assembly 58 also includes a number of minor plates 86 welded at the periphery of the matrix provided by first and second sets 60 and 72 of major plates. As is illustrated in FIG. 3, the edges of various plates are movably inserted into elongated channel sections 88 which are welded to wall 46 and which extend substantially perpendicular to floor 42. During use of cask 40, elongated hollow cells (not illustrated) having stainless steel walls which provides substantially square cross sections and which support sheets of a "neutron poison" material such as boron carbide can be inserted into storage slots 84. Fuel assemblies 20 are then inserted into the cells for long-term storage in a helium atmosphere, with the heat generated by assemblies 20 being transmitted via grid basket assembly 58 through narrow, helium-filled gaps at channel sections 88 to wall 46 for dissipation. Alternately storage slots 84 can be used to store consolidated fuel in consolidation cannisters, without the cells, or consolidated fuel and fuel assemblies can be stored in different storage slots in the same cask.

With the foregoing summary as background, FIG. 3 also illustrates a standpipe 90 which is affixed to grid basket assembly 58 and which extends substantially perpendicular to floor 42. As is illustrated in FIG. 4, the the bottom end of pipe 90 is provided with drainage cut-outs 92 so that borated water can reach the interior of pipe 90 when cask 40 is drained, an operation which will be described in detail subsequently. It should be noted that grid basket assembly 58 is spaced slightly above floor 42 and does not impede the flow of water toward cut-outs 92. Cask 40 may be tilted slightly during the drainage operation in order to facilitate the flow of water toward cut-outs 92, or floor 42 may slope slightly toward cut-outs 92.

With continuing reference to FIG. 4, a bottom triangular support element 94 of aluminum is welded to plates 64 and 74 of assembly 58. Element 94 has an opening (not illustrated) through which pipe 90 extends, element 94 being joined to pipe 90 by weld 96. In a similar manner top triangular support element 98, which has an aperture 100 through which pipe 90 extends, is welded to plates 64 and 74. However pipe 100 is not welded to element 98, thereby preventing pipe 90 from straining grid basket assembly 58 if assembly 58 and pipe 90 experience different expansion rates as the temperature within cask 40 varies.

Figure 5:
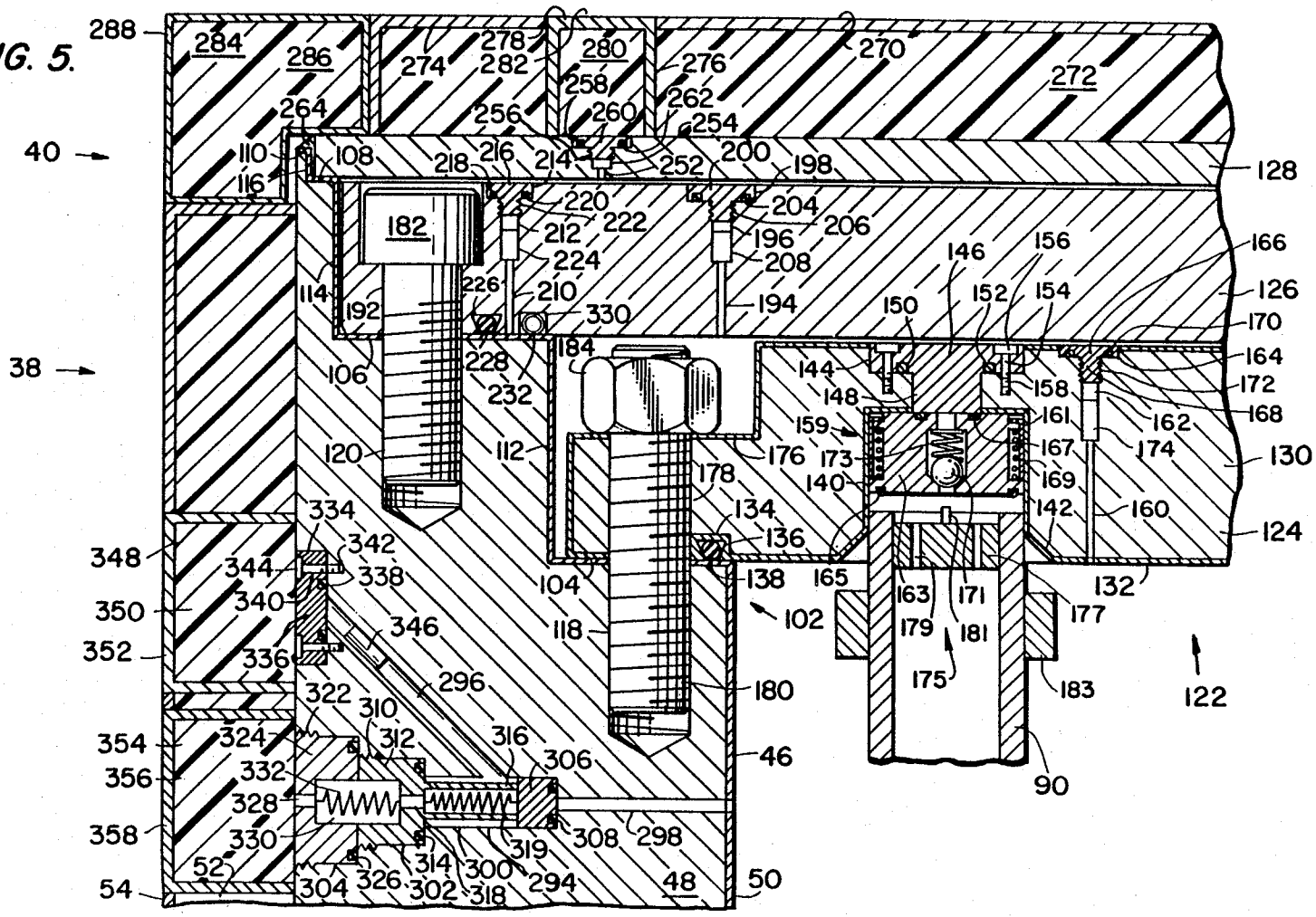
FIG. 5 is a sectional view showing a portion of the mouth region of the cask base element and the lid assembly after installation thereof.

Turning now to FIG. 5, base element 38 terminates upwardly in a stepped mouth region 102 which includes horizontal portions 104, 106, 108, and 110. Region 104 also includes vertical portions 112, 114, and 116. Stainless steel cladding layer 50 extends over stepped mouth region 102. Threaded bores 118 are provided in horizontal section 104 and threaded bores 120 are provided in horizontal portion 106.

With continuing reference to FIG. 5, lid assembly 122 includes a shield lid 124, a primary cover 126 of carbon steel, and a seal cover 128 of stainless steel. Seal lid 124 has a carbon steel portion 130 with a stainless steel cladding layer 132, which can be applied by welding as previously discussed. Portion 130 is provided with an annular recess 134 which, during the cladding operation, is filled with stainless steel so that layer 132 extends into recess 134. An annular recess 136 having a dovetail-shaped cross section is cut into the stainless steel in recess 134. Elastomer O-ring 138 is "captured" within recess 136 so that it can be permanently installed when shield lid 124 is fabricated, and consequently need not be positioned immediately before lid 124 is mounted on cask base element 38. It should be noted that the portion of stainless steel cladding 50 on horizontal portion 104 that will receive O-ring 138 is machined to provide a flat surface in order to properly seat O-ring 138.

With continuing reference to FIG. 5, channel 140 has a conical lower portion 142 and an upper portion 144 configured to receive head 146 of stainless steel plug 148. Annular recess 150 in head 146 accommodates metal O-ring 152. O-ring 152 is "captured" in plug 148 by applying small dabs of adhesive connecting the sides of O-ring 152 to the walls of recess 150 at several points when plug 148 is being fabricated, with care being taken to avoid contaminating the sealing surfaces of O-ring 152 with adhesive. Alternatively O-ring 152 can be captured in plug 148 by providing two clamps (not illustrated) which are installed in recesses (not illustrated) adjacent recess 150 and which extend toward O-ring 152 to keep it in place. With O-ring 152 captured in this manner, plug 148 can be manipulated as a unit. A ring of unthreaded bores 154 around the periphery of head 146 accommodates cap screws 156, which have threaded lower portions that are received by threaded bores 158 in shield lid 124.

With continuing reference to FIG. 5, valve 159 is positioned within channel 140 slightly above the upper end of standpipe 90 (to permit thermal expansion thereof), and includes a valve housing 161 that is welded to lid 124, a valve element 163 that is slidably mounted in housing 161, metal O-rings 165 and 167 captured at either end of element 163, a spring 169 which is affixed to the lower end of housing 161 and which biasses element 163 upward, a ball 171 movably contained within element 163, and a spring 173 biassing ball 171 downward. As will be discussed subsequently, valve 159 cooperates with valve actuator 175 in standpipe 90. Valve actuator 175 includes a plate 177 which is affixed to the interior of standpipe 90 and which has a ring of passages 179 therein. Pin 181 is affixed to plate 177 at a position below ball 171. The thickness of plate 177, and shielding ring 183 around standpipe 90, protect springs 169 and 173 from the full effect of the neutron flux.

With continuing reference to FIG. 5, gas passage 160 has an enlarged intermediate portion 162 and an upper portion 164 which accommodates head 166 of threaded stainless steel plug 168. Head 166 is provided with an annular recess in which metal O-ring 170 is captured in the manner previously described. Upper region 172 of portion 162 is threaded to receive plug 168. A quick disconnect coupling 174 is mounted within portion 162 beneath upper region 172. Coupling 174 includes an internal ball valve (not illustrated) and is configured to be snap-connected to a corresponding quick disconnect coupling on a gas tube. Suitable quick disconnect couplings are known in the art and are commercially available.

With continuing reference to FIG. 5, shield lid 124 also has a peripheral region 176 of reduced thickness through which 36 unthreaded bores 178 extend.

Figure 8:
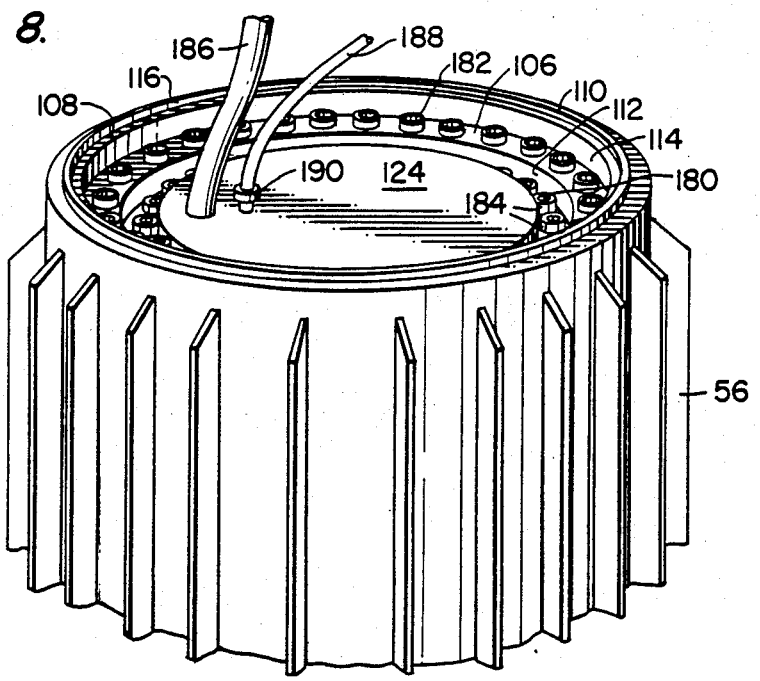
FIG. 8 is a perspective view illustrating the upper portion of the cask base element after the shield lid element has been installed, and illustrates a water removal hose and a gas tube connected to closable openings therein during drainage of water from the cask.

With reference next to both FIGS. 5 and 8, the installation of shield lid 124 will now be described. Before cask base element 38 is lowered to cask pad 36 (FIG. 2), and preferably during fabrication of element 38, studs 180 are coated with sealant and screwed into threaded bores 118. In order to keep water out of bores 120, cap screws 182 are also coated with sealant and temporarily installed in bores 120. Shield lid 124 is installed after fuel assemblies 20 have been loaded into base element 38 and while element 38 is still positioned on cask pad 36. During the first stage of installation plug 148 (along with captured O-ring 152) and plug 168 (along with captured O-ring 170) are absent from shield lid 124. By remote control shield lid 124 is lowered to base element 38 and aligned with it, so that standpipe 90 is positioned for insertion into portion 142 of channel 140 and so that studs 180 are positioned for insertion through bores 178. Nuts 184 are then screwed onto studs 180 and water removal hose 186 is inserted into channel 140, where metal O-ring 167 creates a seal with the end of hose 186. Further downward pressure by hose 186 displaces valve element 163 until metal O-ring 165 is sealed against the end of standpipe 90. Just before this latter seal is created, pin 181 displaces ball 171 to create a flow path from standpipe 90, through passages 179 and valve 159, to hose 186. Helium supply tube 186 terminating in quick disconnect coupling 188 is inserted into gas passage 160, where coupling 188 snaps together with coupling 174 and opens the internal valve in coupling 174. Helium is injected into cask 40 and the borated water is simultaneously removed via hose 186 and pumped to a decontamination facility. It should be noted that the spent fuel elevates the temperature within cask 40 to the boiling point of the borated water as the borated water is being removed, so that a long drying time is unnecessary in order to remove the last traces of water. Upon completion of drainage hose 186 and tube 188 are removed, and quick disconnect coupling 174 and valve 159 act as adequate shields for retaining the helium within cask 40. Cask 40 is then removed from pool 30 and allowed to dry, cap screws 182 are removed, and horizontal portion 106 is polished in preparation for installation of primary cover 126. This installation is accomplished by remote control since, although lid 124 is in place, the flux of radiation through lid 124 is still sufficient to constitute a health hazard. It should be noted that shield lid 124 constitutes the primary shield against impacts, for example impacts arising from accidental drops or accidents while cask 40 is disposed in a horizontal position during transportation.

Returning to FIG. 5, primary cover 126 includes a ring of thirty six unthreaded bores 192 at its periphery, the upper portions of bores 192 being enlarged in order to accommodate the caps of cap screws 82. Gas passage 194 has an enlarged intermediate portion 196 and an upper portion 198 which accommodates the head 200 of threaded plug 202. Head 202 has an annular recess which accommodates metal O-ring 204, O-ring 204 being captured in the recess in the manner previously described. Intermediate portion 196 has a threaded region 206 for receiving plug 200. A quick disconnect coupling 208 is mounted in portion 196 at a position spaced apart from threaded region 206.

With continuing reference to FIG. 5, gas passage 210 has an enlarged intermediate portion 212 and an upper portion 214 which accommodates the head 216 of threaded plug 218. Head 282 includes an annular recess wherein a metal O-ring 220 is captured, in the manner previously described. Intermediate portion 212 includes a threaded region 222 for receiving plug 218. A quick disconnect coupling 224 is mounted in portion 212 at a position spaced apart from region 222.

With continuing reference to FIG. 5, the underside of primary cover 126 is provided with an annular recess 226 which has a dovetail-shaped cross section so that elastomer O-ring 228 can be captured therein. Annular recess 330, which is concentric with respect to recess 226, is also provided in primary cover 126. It should be noted that recesses 226 and 230 are positioned adjacent each other, and the gas passage 210 communicates with the region between recesses 226 and 230. Spring energized C-ring 232 is captured in recess 230, as will be described. During the assembly of cask base element 38, the region of horizontal portion 106 that will receive rings 228 and 232 is machined to provide a flat surface.

Figure 6:
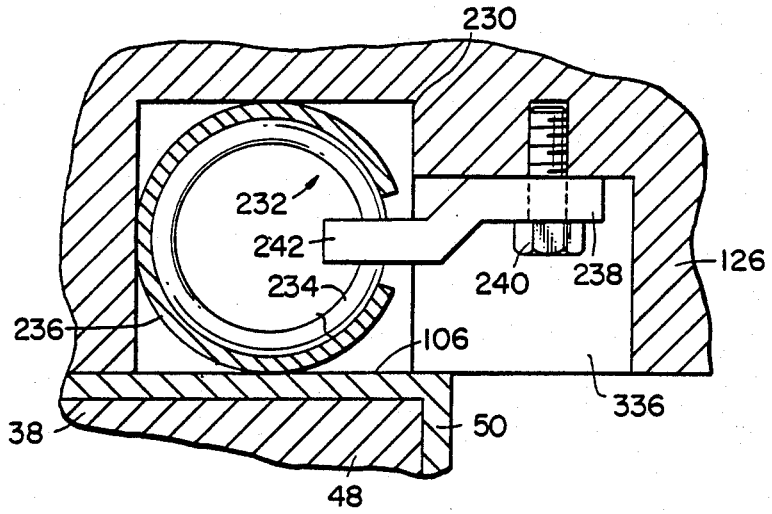
FIG. 6 is a sectional view illustrating a spring energized metal C-ring which is captured in the primary cover to provide the primary gas seal.
Figure 7:
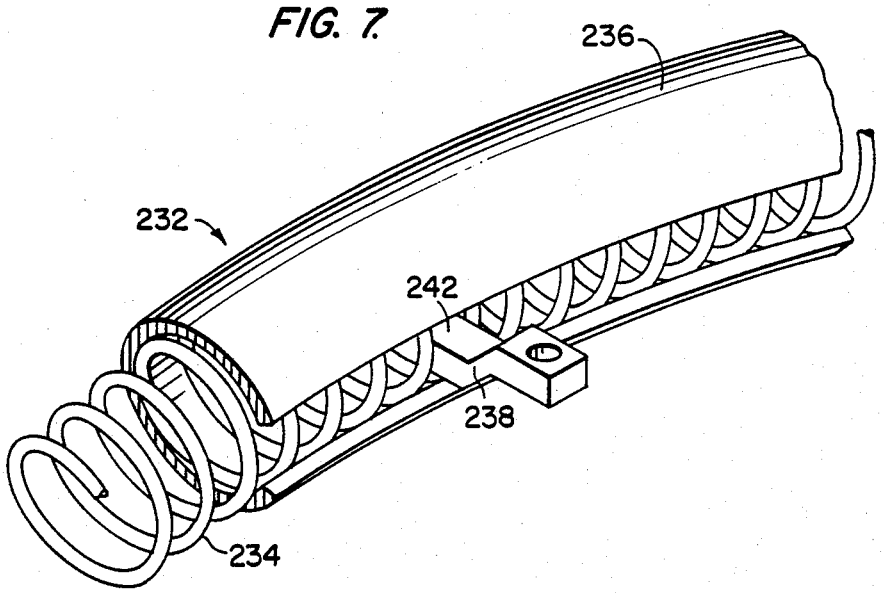
FIG. 7 is a perspective view illustrating a portion of the C-ring of FIG. 6.

Turning next to FIGS. 6 and 7, C-ring 232 includes a helical spring 234 partially surrounded by a stainless steel cover 236. Such spring energized C-rings are commercially available. At three places equally spaced around recess 230 additional recesses 236 are provided in primary cover 126. Mounting lugs 238 are affixed within recesses 236 by cap screws 240. Fingers 242 of mounting lugs 238 extend between the coils of spring 234 to capture ring 232 within recess 230.

Figure 9:
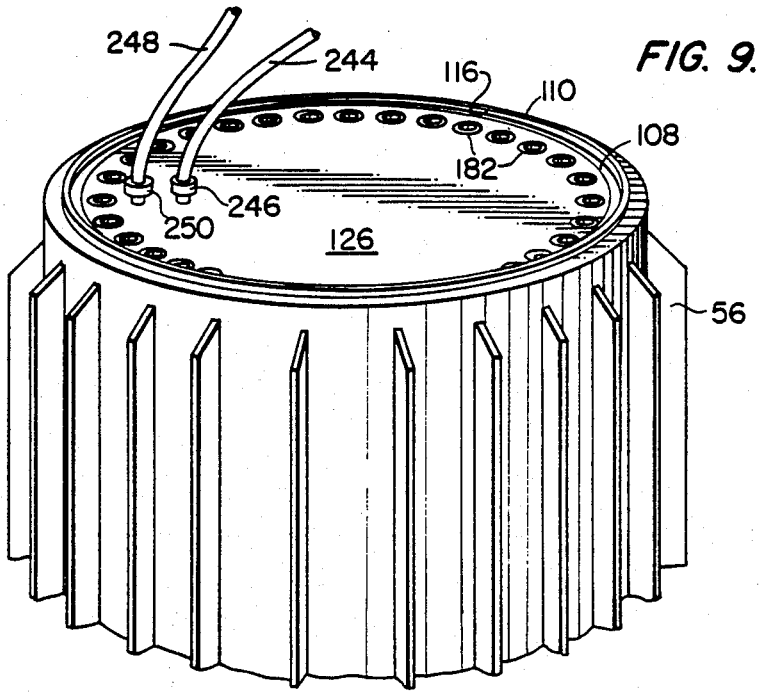
FIG. 9 is a perspective view of the upper portion of the cask base element after the primary cover has been installed, and illustrates gas tubes which are installed in closable gas passages during testing of the primary gas seal.

With reference next to both FIGS. 5 and 9, the procedure for installing primary cover 126 will now be described. Cover 126, with rings 228 and 232 captured therein but with plugs 202 and 218 (with their captured O-rings 204 and 220) removed, is positioned on base 38 so that bores 192 are aligned with bores 120. Screws 182 are then installed. Spring energized C-ring 232 provides the primary gas seal for lid assembly 122, and gas passages 194 and 210 are provided so that this primary seal can be tested when primary cover 126 is installed. Helium supply tube 244 terminating in quick disconnect coupling 246 is inserted into passage 194, where coupling 246 is snapped together with coupling 208. In a similar manner leakage testing tube 248 terminating in quick disconnect coupling 250 is inserted in passage 210. Helium at about two atmospheres pressure is injected into the space between shield lid 124 and primary cover 126 via tube 244. Leakage is then measured, preferably by a gas chromatograph helium leak detector connected to tube 248. Suitable leak detectors are commercially available. A typical figure for a maximum acceptable leakage rate is $10^{-4}$ cubic centimeters per second of helium at standard temperature and pressure.

Spring energized C-ring 232 is capable of providing excellent sealing performance over prolonged periods if it is adequately seated at initial installation. Determining whether ring 232 is properly seated is the purpose of the testing procedure described above. A minute particle of grit, or a slight imperfection in ring 232 or the sealing surfaces of recess 330 or portion 106, may cause an unacceptable leakage rate. The remaining rings present in the cask closure system of the present invention are not nearly as critical as ring 232 and consequently need not be tested. The metal O-rings, such as rings 152, 170, 204, and 220 captured in plugs 148, 168, 202, and 218, respectively, are intrinsically highly reliable and, at any rate, have relatively small dimensions and are consequently not susceptible to excessive leakage rates even if minor defects occur. Elastomer O-ring 138, which is not relied upon for long-term gas sealing, may deteriorate over time due to the heat generated by the spent fuel. O-ring 138 is present primarily to seal shield lid 124 with respect to base element 138 as helium is being injected via passage 160 during the water removal procedure. Similarly, elastomer O-ring 228 is not relied upon for longterm sealing; ring 228 merely serves to define an isolated region around ring 232 for sampling by the helium detector when ring 232 is tested.

With reference once again to FIG. 5, stainless steel seal cover 128 has a gas passage 252 within which is mounted a quick disconnect coupling 254. Passage 252 has a threaded region 256 and a portion 258 which accommodates the head of threaded plug 260. The head of threaded plug 260 includes an annular recess wherein a metal O-ring 262 is captured, in the manner previously described.

Figure 10:
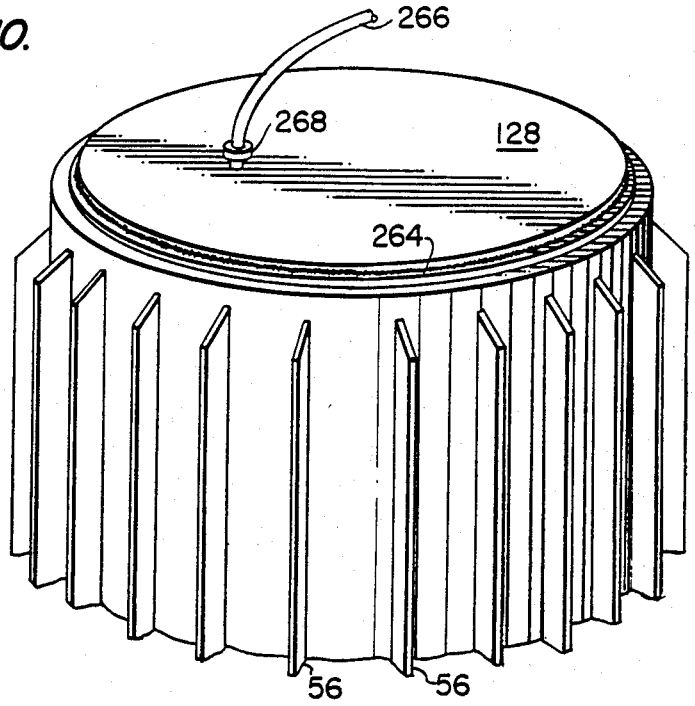
FIG. 10 is a perspective view of the upper portion of the cask base element after the seal cover has been installed, and illustrates a gas tube inserted into a closable gas passage during testing of the secondary seal.
Figure 11:
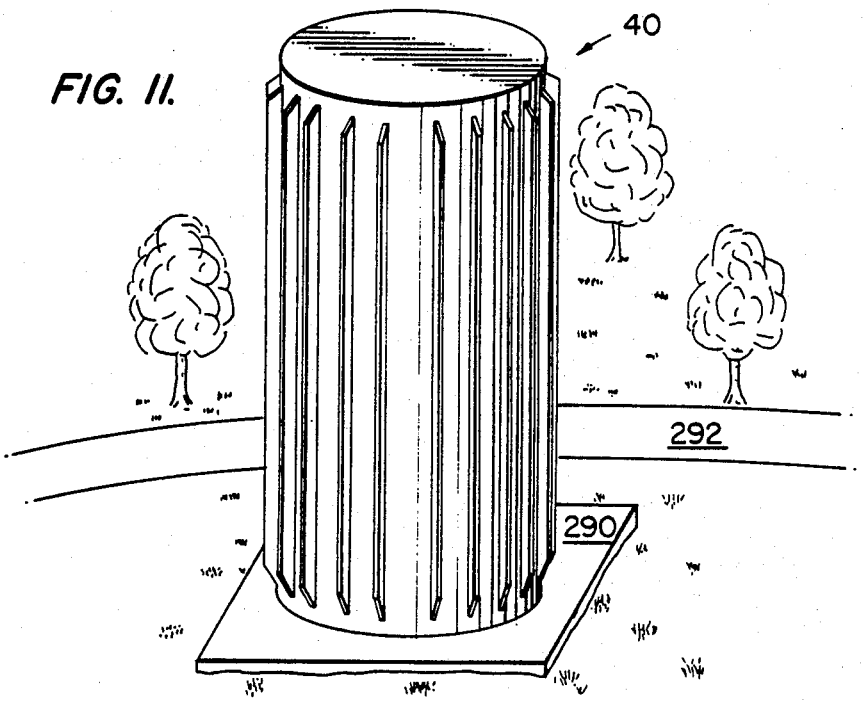
FIG. 11 is a perspective view of the cask during long-term storage.

With reference next to both FIGS. 5 and 10, the installation of seal cover 128 will now be described. After cover 128 is positioned on horizontal portion 108, the level of the whole body radiation escaping through lid assembly 122 is relatively modest, so that it is safe for the further sealing procedures to be accomplished without remote control. The periphery of seal cover 12B is welded to horizontal portion 110 by a weld 264, which provides the secondary gas seal of the closure system of the present invention. This seal is tested by injecting helium at about two atmospheres pressure, via a helium supply tube 266 which terminates in a quick release coupling 268 which snaps together with coupling 254 in gas passage 252, into the region between primary cover 126 and seal cover 128. Leakage is tested around weld 264 using a gas chromatograph helium leak detector or other leak detecting apparatus. Thereafter a top cover 270 having a layer about 7.0 cm thick of neutron absorbing material 272 and an outer layer 274 of stainless steel is adhesively aplied to seal cover 128. Cover 270 has a cylindrical opening 276 for accommodating plug 278, which allows access to plug 260 in case testing of weld 264 is desired at a later date. Plug 278 has a body of neutron absorbing material 280 with a stainless steel outer layer 282. After top cover 270 is applied, ring cover 284, having a body of neutron absorbing material 286 and an outer layer 288 of stainless steel, is welded in place to complete the closure operation. Cask 40 and the spent fuel therein then can be transported to a remote site for storage. Such a storage site is illustrated in FIG. 11, which illustrates a cask 40 resting upon a reinforced concrete support 290 in a rural area, an access road 292 being desirable for use when cask 40 is moved to support 290 and for use during periodic monitoring of cask 40.

In addition to periodic visual monitoring, as cask 40 is being stored, it may be desirable to provide continuous electronic monitoring which provides an alarm signal if the pressure within cask 40 falls to a predetermined level, indicating that a gas leak has occurred and that there is a danger of fission products, such as radon gas, reaching the environment. Returning to FIG. 5, the closure system of the present invention provides an optional monitoring system. In Figure 5, a cavity 294 communicating with gas passage 296 is provided in base element 38. Cavity 294 communicates with the interior of cask 40 via gas passage 298. Cavity 294 includes a first cylindrical portion 300 communicating with passage 298, a second cylindrical passage 302 communicating with passage 300, and a third passage 304 communicating with passage 302. A gas pressure sensor assembly 306, which includes a captured metal O-ring 308, is installed in passage 300. Transducers suitable for use in assembly 306 are commercially available. For example, a differential capacitance manometer, available from MKS Instruments Inc., Burlington, Massachusetts 01803 under stock number 221AD-10000, may be used. Passage 302 has a threaded region 310 for installation of first plug element 312, which includes captured metal O-ring 314. Hollow cylindrical portion 316 of element 312 extends to the back of assembly 306 in order to force assembly 306 into firm contact with the end of passage 300 while nevertheless permitting the back of assembly 306 to communicate with gas passage 296. Plug element 312 also includes a vacuum sealed penetration plug 318 for permitting electrical signals to be transmitted through plug element 312. Such penetration plugs are known in the art and include wires extending through ceramic material bonded to the metal forming the remainder of plug element 312. Leads 319 from gas pressure assembly 306 extend through first plug element 312 by way of the hollow interior of portion 316 and plug 318.

With continuing reference to FIG. 5, third passage 304 has a threaded region 322 into which second plug element 324 can be screwed. Element 324 is provided with captured metal O-ring 326 and a vacuum sealed penetration plug 328 of bonded ceramic material through which conductors extend, as previously described. The adjacent faces of plug elements 312 and 324 are confiqured to provide a cavity 330 for accommodating leads 332 extending between plugs 318 and 328. From the foregoing discussion it will be apparent that gas pressure sensor assembly 306 is exposed to the interior of cask 40, that three metal O-rings 308, 314, and 326 seal cavity 294, and that electrical signals from assembly 316 are externally available via leads 319, plug 318, leads 332, and insert 328. External monitoring equipment (not illustrated) of a conventional nature is electrically connected to assembly 306 to provide an alarm signal if gas pressure sensor assembly 306 indicates that the pressure within cask 40 has fallen to a predetermined limit. The alarm signal may be conveyed to a monitoring station where it rings a bell or otherwise attracts attention, or may be used to set a visual indicator device (not illustrated) which is positioned adjacent cask 40 on support 290 and and which is observed during periodic monitoring visits.

The presence of an alarm signal does not necessarily mean that cask integrity has been breached. It is far more likely that an alarm signal is the result of an erroneous signal from the pressure transducer within assembly 306. The electrical properties of a transducer tend to slowly change over time, and an electrical "drift" of this nature is particularly likely when a transducer is subjected to the harsh environment within cask 40. Accordingly, when an alarm signal is received it is appropriate to first recalibrate the transducer, to ensure that the alarm signal is valid, before cask 40 is returned to pool 30.

With continuing reference to FIG. 5, gas passage 296 terminates in a recess 334 into which plug element 336 is inserted. Plug element 336 is provided with a captured metal O-ring 338 and smooth bores 340 which are aligned with threaded bores 342 in base element 38. Cap screws 344 are used to attach element 336 and seal passage 296. After assembly the periphery of plug element 336 is welded to provide a secondary shield. It will be apparent that gas escape via passage 296 is prevented by metal O-rings 308 and 338 and by the weld at plug element 334. A quick disconnect coupling 346, of the type previously discussed, is mounted within gas passage 296.

With continuing reference to FIG. 5, cylindrical plug element 348 having a body of neutron absorbing material 350 about 7.0 cm thick and an outer layer 352 of stainless steel is installed after plug element 336 is welded. In a similar manner cylindrical plug element 354, having a body of neutron absorbing material 356 and an outer layer 358 of stainless steel, covers plug element 224 after it is installed.

Should an alarm signal be received, a technician first measures radioactivity around cask 40, and particularly in the region of plug elements 348 and 354. Measurements of an acceptable level around plug elements 348 and 354 indicate that is safe to remove element 348 and machine away the weld sealing plug element 336. With this weld removed, the technician measures radiation again, and if it is at an acceptable level proceeds to unscrew cap screws 344 and remove plug element 336. A tube terminating in a quick disconnect coupling is then inserted into passage 296, and helium is injected to bring the pressure within passage 300 to a predetermined level in order to calibrate the transducer within assembly 306 by subjecting one side of it to a predetermined pressure. Assuming that this recalibration establishes that the alarm signal was spurious, plug elements 336 and 348 are reinstalled.

From the foregoing description it will be apparent that the spent fuel cask closure system of the present invention provides a mechanically rugged closure having highly reliable, redundant seals. A lid assembly facilitates drainage of the cask and testing of a primary gas seal and a secondary gas seal. The closure system of the present invention also provides for long-term monitoring of pressure within the cask and for recalibration of the monitoring transducer.

I claim:

1. A cask closure system, comprising:

a cask base element having a stepped mouth region communicating with a hollow interior for storing spent nuclear fuel, said stepped mouth region having a first horizontal portion and second horizontal portion disposed above said first horizontal portion; and lid assembly means for closing said mouth region, said lid assembly means including a shield lid having a peripheral region positioned on said first horizontal portion, means for attaching said shield lid to said mouth region, means contacting both said shield lid and said first horizontal portion for providing a gas seal, a primary cover disposed above said shield lid and having a peripheral region positioned on said second horizontal portion, means for attaching said primary cover to said south region, primary sealing means contacting both said primary cover and said second horizontal portion for providing a primary gas seal to prevent gas from the interior of the cask from escaping to the exterior, said primary sealing means including a metal sealing element which is mounted between said primary cover and said second horizontal portion without welding and which seals by intimate contact with said primary cover and said second horizontal portion, and further sealing means disposed between said primary cover and said second horizontal portion, said further sealing means extending around said metal sealing element and being spaced apart from said metal sealing element by a gap.

wherein said primary cover has a first gas passage inward of said metal sealing element to receive gas injected between said shield lid and said primary cover to test said primary sealing means and a second gas passage outward of said metal sealing element and inward of said further sealing means to receive any gas that has leaked through primary sealing means and collected in said gap during the test so that the leakage gas can be detected.

2. A system claim 1, wherein said metal sealing element comprises a spring energized metal C-ring, and wherein, said further sealing means comprises an elastomer O-ring disposed around said C-ring.

3. The system of claim 1, further comprising first means for sealing said first gas passage and second means for sealing said second gas passage.

4. The system of claim 1, wherein said stepped mouth region includes a third horizontal portion disposed above said, second horizontal portion, and wherein said lid assembly means furthuer includes a seal cover having a peripheral region positioned on said third horizontal portion, and means extending between said seal cover and said mouth region for providing a secondary gas seal to prevent gas from the interior of the cask from escaping to the exterior, wherein said seal cover has a third gas passage inward of said secondary gas seal to receive gas injected between said primary cover and said seal cover to test said secondary gas seal.

5. The system of claim 4 further comprising third means for sealing said third gas passages.

6. They system of claim 5 wherein said means extending between said cover and said mouth region is a weld.

7. The system of claim 1, wherein said shield lid has a fourth gas passage inward of said means contacting both said shield lid and said first horizontal portion.

8. They system of claim 7, further comprising fourth means for sealing said fourth gas passage.

9. A cask closure system, comprising:

a cask base element having a stepped mouth region communicating with a hollow interior for storing spent nuclear fuel, said stepped mouth region having a first horizontal portion and a second horizontal portion disposed above said first horizontal portion;

lid assembly means for closing said mouth region, said lid assembly means including a shield lid having a peripheral region positioned on said first horizontal portion, means for attaching said shield lid to said mouth region, and means contacting both said shield lid and said first horizontal portion for providing a gas seal, said lid assembly means additionally including a primary cover disposed above said shield lid and having a peripheral region positioned on said second horizontal portion, means for attached said primary cover to said mouth region, and means for contacting both said primary cover and said second horizontal portion for providing a primary gas seal to prevent gas from the interior of the cask from escaping to the exterior, wherein said primary cover has a first gas passage inward of said primary gas seal to receive gas injected between said shield lid and said primary cover to test said primary gas seal and a second gas passage outward of said primary gas seal to receive any gas that has leaked through said primary gas seal during the test so that the leakage gas can be detected, and wherein said shield lid has a channel with an enlarged lower portion and has a further gas passage inward of said means contacting both said shield lid and said first horizontal portion;

means for sealing said further gas passage; and a standpipe extending into the interior of said cask and having an end that is positioned within said enlarged lower portion of said channel.

10. The system of claim 9, further comprising a valve in said channel and cooperating with said standpipe, and means for sealing said channel.

11. A cask closure system, comprising;

a cask base element having a stepped mouth region communicating with a hollow interior for storing spent nuclear fuel, said stepped mouth region having a first horizontal portion and a second horizontal portion disposed above said first horizontal portion, said cask base element additionally having a cavity therein extending from outside of said base element, a first gas passage communicating between said cavity and the interior of said cask, and a second gas passage communicating between the cavity and the outside of said base element, lid assembly means for closing said mouth region, said lid assembly means including a shield lid having a peripheral region positioned on said first horizontal portion, means for attaching said sheild lid to said mouth region, and means contacting both said shield lid and said first horizontal portion for providing a gas seal, said lid assembly means additionally including a primary cover disposed above said shield lid and having a peripheral region positioned on said second horizontal portion, means for attaching said primary cover to said mouth region, and means contacting both said primary cover and said second horizontal portion for providing a primary gas seal to prevent gas from the interior of the cask from escaping to the exterior, wherein said primary cover has a third gas passage inward of said primary gas seal to receive gas injected between said shield lid and said primary cover to test said primary gas seal and a fourth gas passage outward of said primary gas seal to receive any gas that has leaked through said primary gas seal during the test so that the leakage gas can be detected;

pressure monitoring means mounted within said cavity for sensing gas pressure via said first gas passage and for receiving gas for recalibrating said pressure monitoring means via said second gas passage;

means for sealing said cavity; and means for sealing said second gas passage.

12. A method for closing a cask and testing the closure thereof, said cask having a cask base element with a mouth region which communicates with a hollow interior, after the base element has been positioned in a pool of water and spent nuclear fuel has been loaded into the interior, said method comprising steps of:

(a) closing said interior with a shield lid mounted on said base element at said mouth region;

(b) positioning a metal sealing element around said shield lid;

(c) positioning a further sealing means around said shield lid, said further sealing means being spaced apart from said metal sealing element by a gap;

(d) clamping said metal sealing element and said further sealing means between said mouth region and a primary cover mounted on said base element over said shield lid, said primary cover having a first gas passage therethrough opening inwardly of said metal sealing element and a second gas passage therethrough opening outwardly of said metal sealing element, one of said gas passages communicating with said gap;

(e) testing said metal sealing element by introducing gas to the region between said shield lid and said primary cover via one of said gas passages and detecting leakage of the introduced gas via the other of said gas passages; and (f) sealing the first and second gas passages.

13. The method of claim 12, further comprising creating a secondary gas seal by welding a seal cover to said mouth region over said primary cover, said seal cover having a third gas passage therethrough communicating with the region between said seal cover and primary cover; testing said secondary gas seal by introducing gas through said third gas passage to the region between said seal cover and primary cover and detecting leakage of the introduced gas at the weld; and sealing said third gas passage.

14. The method of claim 13, wherein the steps of sealing said first, second, and third gas passages are conducted by inserting plugs and O-rings into said passages.

15. A method for closing a cask and testing the closure thereof, said cask having a cask base element with a mouth region which communicates with a hollow interior, after the base element has been positioned in a pool of water and spent nuclear fuel has been loaded into the interior, said method comprising the steps of:

(a) closing said interior with a shield lid mounted on said base element at said mouth region;

(b) positioning means for providing a primary gas seal around said shield lid;

(c) clamping said means for providing a primary gas seal between said mouth region and a primary cover mounted on said base element over said shield lid, said primary cover having a first gas passage therethrough opening inwardly of said means for providing a primary gas seal and second gas passage therethrough opening outwardly of said means for providing a primary gas seal;

(d) testing said primary gas seal by introducing gas to the region between said shield lid and said primary cover via said first gas passage and detecting leakage of the introduced gas via the second gas passage; and (e) sealing the first and second gas passages, wherein a standpipe is mounted in said hollow interior of said bas element, said standpipe having an end extending into said mouth region, wherein said shield lid has a channel therethrough and an additional gas passage therethrough, wherein said step of closing said interior with a shield lid is accomplished by inserting said shield lid into said mouth region so that said end of said standpipe extends into said channel and by then securing said shield lid to said base element, and wherein said method further includes the steps of injecting gas into the interior of said base element via said additional gas passage while removing water via said standpipe and said channel, and thereafter sealing said channel and said additional gas passage.

16. The method of claim 15, wherein said steps of sealing said channel and said additional gas passage are accomplished by inserting a plug and O-ring into each of said channel and said additional gas passage.

17. A method for closing a cask and testing the closure thereof, said cask having a cask base element with a mouth region which communicates with a hollow interior, after the base element has been positioned in a pool of water and spent nuclear fuel has been loaded into the interior, said method comprising the steps of:

(a) closing said interior with a shield lid mounted on said base element at said mouth region;

(b) positioning means for providing a primary gas seal around said shield lid;

(c) clamping said means for providing a primary gas seal between said mouth region and a primary cover mounted on said base element over said shield lid, said primary cover having a first gas passage therethrough opening inwardly of said means for providing a primary gas seal and a second gas passage therethrough opening outwardly of said means for providing a primary gas seal;

(d) testing said primary gas seal by introducing gas to the region between said shield lid and said primary cover via said first gas passage and detecting leakage of the introduced gas via the second gas passage; and (e) sealing the first and second gas passages, (f) wherein said base element has a wall with a cavity therein which communicates via a third gas passage with said hollow interior of said base element and via a fourth gas passage with the exterior of said base element, wherein a gas pressure sensor assembly is mounted in said cavity, said gas pressure sensor assembly having a portion thereof exposed to said third gas passage and a portion thereof exposed to said fourth gas passage, and wherein said method further includes the steps of monitoring the pressure within said base element with said gas pressure assembly in order to detect a predetermined pressure drop, and recalibrating said gas pressure sensor assembly if said predetermined pressure drop is detected by injecting gas into said fourth gas passage.

18. The system of claim 1, wherein said cask base element has an outer wall with another gas passage therein, and wherein the system further comprises means connected to the outer wall for monitoring the pressure in said hollow interior via said another gas passage.

19. The method of claim 12, wherein said cask base element has an outer wall with another gas passage, and further comprising the step of monitoring the pressure in said hollow interior via said another gas passage.

20. A cask closure system comprising:

a cask base element having an outer wall and having a stepped mouth region communicating with a hollow interior for storing spent nuclear fuel, said outer wall having a first gas passage to said hollow interior and said stepped mouth region having a first horizontal portion and a second horizontal portion disposed above said first horizontal portion;

lid assembly means for closing said mouth region, said lid assembly means including a shield lid having a peripheral region positioned on said first horizontal portion, means for attaching said shield lid to said mouth region, and means contacting both said shield lid and said first horizontal portion for providing a gas seal, said lid assembly means additionally including a primary cover disposed above said shield lid and having a peripheral region positioned on said second horizontal portion, means for attaching said primary cover to said mouth region, and means contacting both said primary covery and said second horizontal portion for providing a primary gas seal to prevent gas from the interior of the cask from escaping to the exterior, wherein said primary cover has a second gas passage inward of said primary gas seal to receive gas injected between said shield lid and said primary cover to test said primary gas seal and a third gas passage outward of said primary gas seal to receive any gas that has leaked through said primary gas seal during the test so that the leakage gas can be detected; and monitoring means connected to said outer wall and communicating with said first gas passage for monitoring the pressure in said hollow interior, said monitoring menas including a sensor which is exposed to said first gas passage, and means for receiving pressurized fluid from outside said cask base element to recalibrate said sensor.

21. A method for closing a cask and testing the closure thereof, said cask having a cask base element with an outer wall and with a mouth region which communicates with a hollow interior, after the base element has been positioned in a pool of water and spent nuclear fuel has been loaded into the interior, said method comprising the steps of:

(a) closing said interior with a shield lid mounted on said base element at said mouth region;

(b) positioning menas for providing a primary gas seal around said shield lid;

(c) clamping said means for providing a primary gas seal between said mouth region and a primary cover mounted on said base element over said shield lid, said primary cover having a first gas passage therethrough opening inwardly of said means for providing a primary gas seal and a second gas passage therethrough opening outwardly of said means for providing a primary gas seal;

(d) testing said primary gas seal by introducing gas to the region between said shield lid and said primary cover via said first gas passage and detecting leakage of the introduced gas via the second gas passage;

(e) sealing the first and second gas passages;

(f) monitoring the pressure in said hollow interior with a sensor which is exposed to said hollow interior via an additional gas passage in said outer wall; and (g) recalibrating said sensor by exposing said sensor to pressurized fluid if said sensor signals that the pressure in said hollow interior has changed by a predetermined amount.

* * * * *